US009441870B2

(12) United States Patent
Nikkanen

(10) Patent No.: US 9,441,870 B2
(45) Date of Patent: Sep. 13, 2016

(54) SNOW MAKING APPARATUS

(71) Applicant: John Pentti Nikkanen, West Hartford, CT (US)

(72) Inventor: John Pentti Nikkanen, West Hartford, CT (US)

(73) Assignee: LP Snow Systems, LLC, West Hartford, CT (US)

( * ) Notice: Subject to any disclaimer, the term of this patent is extended or adjusted under 35 U.S.C. 154(b) by 0 days.

(21) Appl. No.: 14/223,486

(22) Filed: Mar. 24, 2014

(65) Prior Publication Data

US 2014/0284396 A1 Sep. 25, 2014

Related U.S. Application Data

(60) Provisional application No. 61/804,454, filed on Mar. 22, 2013.

(51) Int. Cl.

| | |
|---|---|
| ***F25C 3/04*** | (2006.01) |
| ***B05B 7/06*** | (2006.01) |
| ***B05B 1/34*** | (2006.01) |
| ***B05B 7/10*** | (2006.01) |

(52) U.S. Cl.

CPC ..... *F25C 3/04* (2013.01); *B05B 1/3421* (2013.01); *B05B 1/3426* (2013.01); *B05B 7/06* (2013.01); *B05B 7/10* (2013.01); *F25C 2303/00* (2013.01); *F25C 2303/0481* (2013.01)

(58) Field of Classification Search

CPC ..... F25C 3/04; F25C 2303/00; F25C 2303/0481; B05B 1/3426; B05B 1/3421; B05B 7/06; B05B 7/10

USPC ..... 239/14.2, 403–406, 419, 423, 424, 468

See application file for complete search history.

(56) References Cited

U.S. PATENT DOCUMENTS

| | | | | | |
|---|---|---|---|---|---|
| 3,908,903 | A | * | 9/1975 | Burns, Jr. | 239/14.2 |
| 4,353,504 | A | * | 10/1982 | Girardin et al. | 239/14.2 |
| 5,135,167 | A | * | 8/1992 | Ringer | 239/14.2 |
| 5,909,844 | A | * | 6/1999 | Nilsson | 239/14.2 |
| 6,129,290 | A | * | 10/2000 | Nikkanen | 239/14.2 |
| 7,114,662 | B1 | | 10/2006 | Nikkanen | |

* cited by examiner

*Primary Examiner* — Steven J Ganey

(74) *Attorney, Agent, or Firm* — O'Shea Getz P.C.

(57) ABSTRACT

A snow making apparatus is provided that includes a manifold, a nucleator annular chamber, and a plurality of nucleator nozzles. The manifold is configured to receive water from a water source and air from an air source. The nucleator annular chamber is configured to receive an air-water mixture from first passages, which first passages are oriented to direct the air-water mixture tangentially into the nucleator annular chamber for subsequent circumferential and axial travel within the annular chamber. The plurality of nucleator nozzles is positioned to receive the air-water mixture from the nucleator annular chamber.

19 Claims, 7 Drawing Sheets

SNOW MAKING APPARATUS

This application claims priority to U.S. Patent Appln. No. 61/804,454 filed Mar. 22, 2013, which application is hereby incorporated by reference in its entirety.

BACKGROUND OF THE INVENTION

1. Technical Field

The present invention relates to devices for making artificial snow, in particular, to devices which use water and air to form and project snow over outdoor areas, such as ski slopes.

2. Background Information

For a number of years it has been the practice to employ equipment to deposit artificially made snow on outdoor surfaces, such as ski slopes, when nature does not provide the desired quantity of snow. A variety of mechanical devices have been employed. Generally, the approach is to take water droplets and convert them to frozen particles. Prior art devices typically break up a stream of water by means of pressure atomizing and or two-fluid (air-water) atomizing. Often fans are used to provide an airstream which entrains the droplets as they become frozen, and better to carry them through space and deposit them across a wide area.

There are various problems and limitations connected with prior art snow making devices. They include complexity, noise, reliability, weight, difficult maneuverability, low efficiency in covering a desired area, poor ability for making snow at comparatively warm temperatures, high initial cost, and high operating cost.

SUMMARY OF THE INVENTION

According to a first aspect of the invention, a snow making apparatus is provided that includes a manifold, a nucleator annular chamber, and a plurality of nucleator nozzles. The manifold is configured to receive water from a water source and configured to receive air from an air source. The nucleator annular chamber is configured to receive an air-water mixture from first passages, which first passages are oriented to direct the air-water mixture tangentially into the nucleator annular chamber for subsequent circumferential and axial travel within the annular chamber. The plurality of nucleator nozzles is positioned to receive the air-water mixture from the nucleator annular chamber. The nucleator nozzles are configured to allow the air-water mixture to exit the apparatus through the nozzles.

According to another aspect of the present invention, a snow making apparatus is provided that includes a manifold, a nucleator mix nozzle, a primary nozzle, an annular cavity, and a filter. The manifold is configured to receive water from a water source and configured to receive air from an air source. The annular cavity is disposed downstream of the manifold, configured to receive the water from the manifold. The filter has an aft end. The filter is configured to receive a portion of the water traveling through the annular cavity, which portion is directed to travel through the nucleator mix nozzle. The remaining portion of the water traveling through the annular cavity is directed to exit the apparatus through the primary nozzle.

According to another aspect of the present invention, a snow making apparatus is provided that includes a manifold, a first ring, a second ring, a primary nozzle, a nucleator mix nozzle, and a nucleator annular chamber. The manifold is configured to receive water from a water source and configured to receive air from an air source. The first ring has a plurality of water passages positioned to receive the water from the manifold. The second ring has a plurality of nucleator nozzles. The primary nozzle is attached to a primary nozzle ring. The nucleator annular chamber is configured to receive an air-water mixture from first passages disposed in the second ring, which first passages are oriented to direct the air-water mixture tangentially into the nucleator annular chamber for subsequent circumferential and axial travel within the annular chamber. The nucleator nozzles are positioned to receive the air-water mixture from the nucleator annular chamber. The nucleator nozzles are configured to allow the air-water mixture to exit the apparatus through the nozzles.

In one or more of the aspects of the snow making apparatus described above, the nucleator annular chamber and first passages are configured to cause the air-water mixture circumferentially and axially traveling within the nucleator annular chamber to experience centrifugal forces sufficient to overcome gravitational forces during normal operating conditions.

The foregoing and other objects, features and advantages of the invention will become more apparent from the following description of preferred embodiments and accompanying drawings.

DETAILED DESCRIPTION

Figure 1:
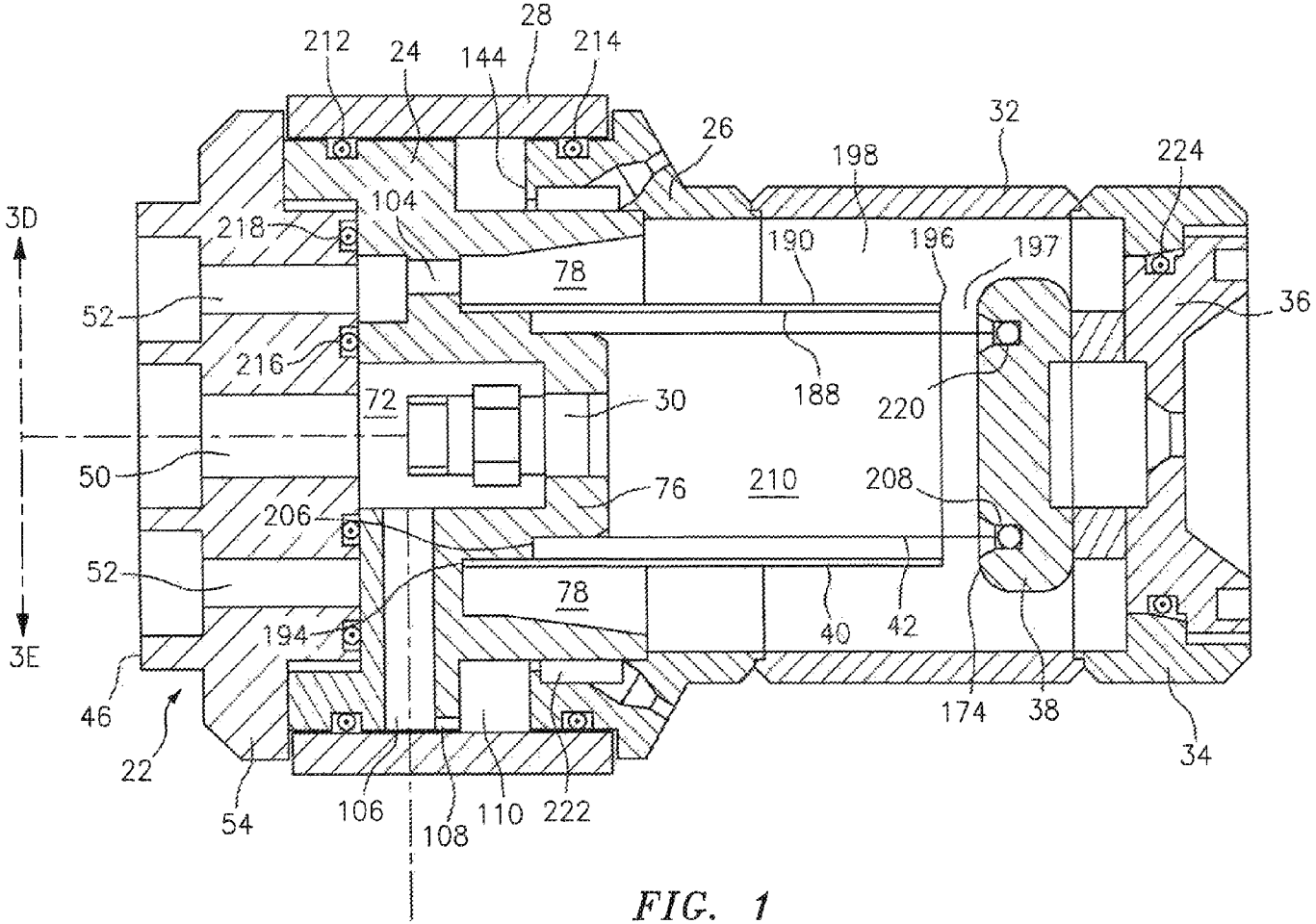
FIG. 1 is a diagrammatic sectional view of an embodiment of the present snow making apparatus (i.e., "snowgun").

Referring to FIG. 1, an embodiment of the present snow making apparatus 20 (hereinafter referred to as a "snowgun 20") includes a fluid inlet manifold 22, a nucleator swirl ring 24, a nucleator nozzle ring 26, a swirl sleeve 28, a nucleator metering nozzle 30, an intermediary ring 32, a primary nozzle ring 34, a primary nozzle 36, an end cap 38, an internal flow sleeve 40, and a water filter 42. The aforesaid elements are described herein individually to facilitate the description and understanding of this embodiment of the present apparatus. One or more of the elements may be combined into unitary elements and still be within the scope of the present invention. In addition, the embodiment shown in FIGS. 1-11 is shown in a circular/tubular configuration having a central axis 44, which configuration is advantageous for manufacturing purposes. The present invention is not limited to this configuration.

Figure 2A:
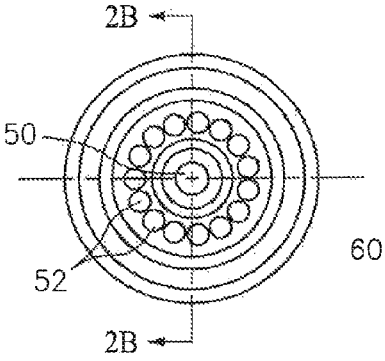
FIG. 2A is a diagrammatic planar view of the first end surface of the fluid inlet manifold element of the present snowgun.
Figure 2B:
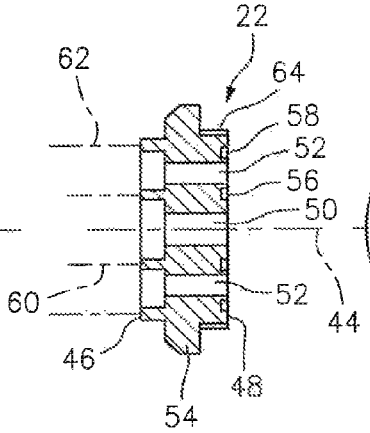
FIG. 2B is a diagrammatic sectional view of the fluid inlet manifold element of the present snowgun.
Figure 2C:
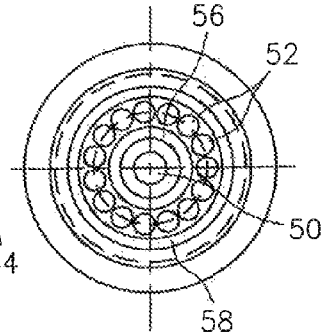
FIG. 2C is a diagrammatic planar view of the second end surface of the fluid inlet manifold element of the present snowgun.

Referring to FIGS. 2A-2C, the fluid inlet manifold 22 includes a body extending axially between a first end surface 46 and a second end surface 48, a centrally located air passage 50, a plurality of water passages 52, a radially extending flange 54, an inner radial seal channel 56, and an outer radial seal channel 58. Relatively speaking, the first end surface 46 may be described as being "aft" of the second end surface 48, and the second end surface 48 may be described as being "forward" of the first end surface 46. The inner and outer radial seal channels 56, 58 are disposed in the second end surface 48. As shown in imaginary lines in FIG. 2B, an air source conduit 60 (e.g., a pipe, tube, etc.) is typically attached to the manifold 22 between the air passage 50 and the water passages 52 to provide an air conduit to the air passage 50. Air at an elevated pressure (e.g., relative to ambient produced by a compressor) and a known volumetric flow rate is provided to the snowgun 20 via the air source conduit 60. Also as shown in imaginary lines, a water source conduit 62 (e.g., a pipe, tube, etc.) is typically attached to the manifold 22 at or outside the water passages 52 to provide a water conduit to the water passages 52. Water at an elevated pressure (e.g., relative to ambient produced by a pump) and a known volumetric flow rate is provided to the snowgun 20 via the water source conduit 62. In the embodiment shown in FIGS. 2A-2C, a portion 64 of the exterior surface of the body is threaded to permit attachment of the manifold 22 to the nucleator swirl ring 24.

Referring to FIGS. 3A-3E, the nucleator swirl ring 24 includes a body extending axially between a first end surface 66 and a second end surface 68, a manifold cavity 70, a metering nozzle cavity 72, a plurality of flow channels 74, a hub 76, and a cavity 78. The manifold cavity 70 is disposed in the first end surface 66 and includes an outer diameter surface 80, and a radial surface 82. The metering nozzle cavity 72 is disposed in the radial surface 82 of the manifold cavity 70. The plurality of arcuate channels 74 is disposed in the radial surface 82 of the manifold cavity 70, radially outside of the metering nozzle cavity 72. The embodiment shown in FIGS. 3A-3E shows a pair of flow channels 74, but the nucleator swirl ring 24 is not limited to the two flow channel configuration. The cavity 78 is disposed in the second end surface 68 and includes an inner diameter surface 84, and a radial surface 86. In the embodiment shown in FIGS. 3A-3E, a portion of the inner diameter surface 84 of the cavity 78 is disposed at an non-parallel angle to the central axis 44 of the snowgun 20; e.g., within the portion of the inner diameter surface 84, the radius of the inner diameter surface 84 increases in the direction toward the second end surface 68, thereby decreasing the contiguous wall thickness. The exterior of the nucleator swirl ring 24 includes a first outer diameter surface 88 extending from the first end surface 66, a second outer diameter surface 90 extending from the second end surface 68, and a radial surface 92 extending between the first and second outer diameter surfaces 88, 90. The diameter of the first outer diameter surface 88 is greater than the diameter of the second outer diameter surface 90. An O-ring seal channel 94 is disposed in the first outer diameter surface 88.

The hub 76 is disposed contiguous with the metering nozzle cavity 72. A first passage 96 extends through the hub 76, permitting fluid (e.g., water) passage through the nucleator swirl ring 24. The hub 76 includes a first outer diameter surface 98, a second outer diameter surface 100, and a radial surface 102 extending between the first and second outer diameter surfaces 98, 100. The diameter of the first outer diameter surface 98 is greater than the diameter of the second outer diameter surface 100.

A plurality of axial passages 104 extend between the flow channels 74 and the cavity 78, permitting fluid (e.g., water) flow through the nucleator swirl ring 24. In the embodiment shown in FIGS. 3A-3E (FIG. 3D is a cross-sectional view along the slice line "3D-3D" shown in FIG. 3B), the axial passages 104 extend exclusively in an axial direction, parallel to the central axis 44. In a preferred embodiment, the axial passages 104 are disposed at a tangential angle (e.g., in the range of 15-20 degrees) relative to the central axis 44 to direct water exiting the axial passages 104 to travel both circumferentially and axially (i.e., a direction that causes the water to circumferentially "swirl") as will be explained below (e.g., see FIG. 11).

Referring to FIG. 1, the nucleator metering nozzle 30 is disposed in the metering nozzle cavity 72, attached to the hub 76; e.g., by screw thread. The nucleator metering nozzle 30 includes an orifice having a diameter, through which water may flow.

Figure 3A:
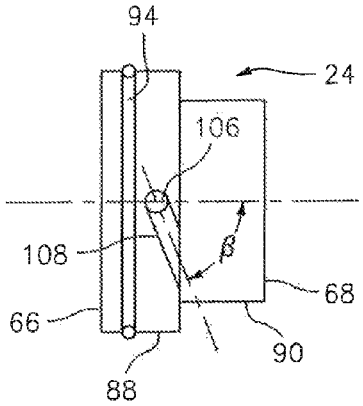
FIG. 3A is a diagrammatic side view of the nucleator swirl ring element of the present snowgun.
Figure 3B:
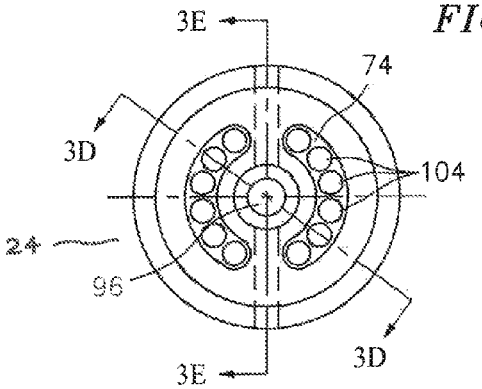
FIG. 3B is a diagrammatic planar view of the first end surface of the nucleator swirl ring element of the present snowgun.
Figure 3C:
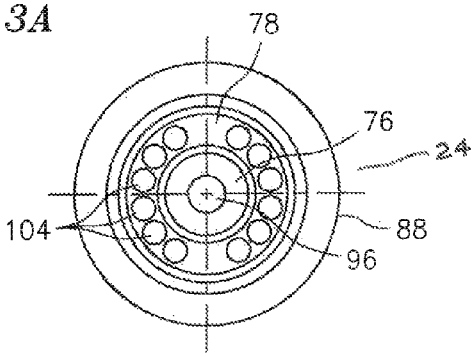
FIG. 3C is a diagrammatic planar view of the second end surface of the nucleator swirl ring element of the present snowgun.
Figure 3D:
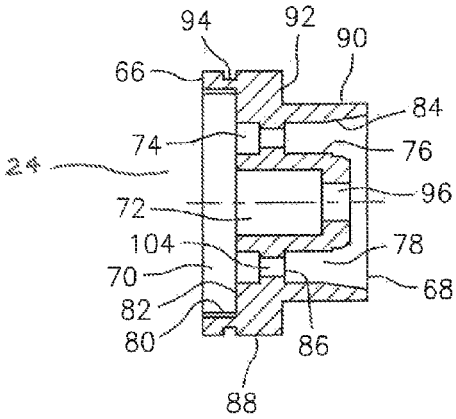
FIG. 3D is a diagrammatic sectional view of the nucleator swirl ring element of the present snowgun.
Figure 3E:
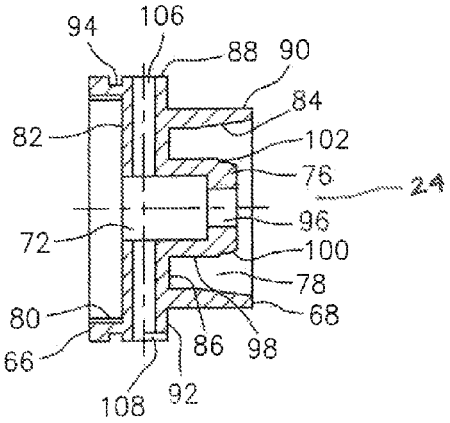
FIG. 3E is a diagrammatic sectional view of the nucleator swirl ring element of the present snowgun.

Referring to FIGS. 3A-3E (FIG. 3E is a cross-sectional view along the slice line "3E-3E" shown in FIG. 3B), the nucleator swirl ring 24 also includes a plurality of radial passages 106, each extending radially between the metering nozzle cavity 72 and an angled passage 108 (see FIG. 3A). Each angled passage 108 extends in a direction having a circumferential component and an axial component (e.g., shown as angle "β" relative to the central axis 44), between the radial passage 106 and the first outer diameter surface 88, breaking through to the radial surface 92 extending between the first and second outer diameter surfaces 88, 98 of the swirl ring 24. As will be described below, the orientation of the angled passages 108 is such that water flowing through the angled passages 108 tangentially enters a swirl chamber 110 (formed by the nucleator swirl ring 24, the nucleator nozzle ring 26, and the swirl sleeve 28—see FIGS. 1 and 10) for travel around the outer circumference of the swirl chamber 110.

Figure 10:
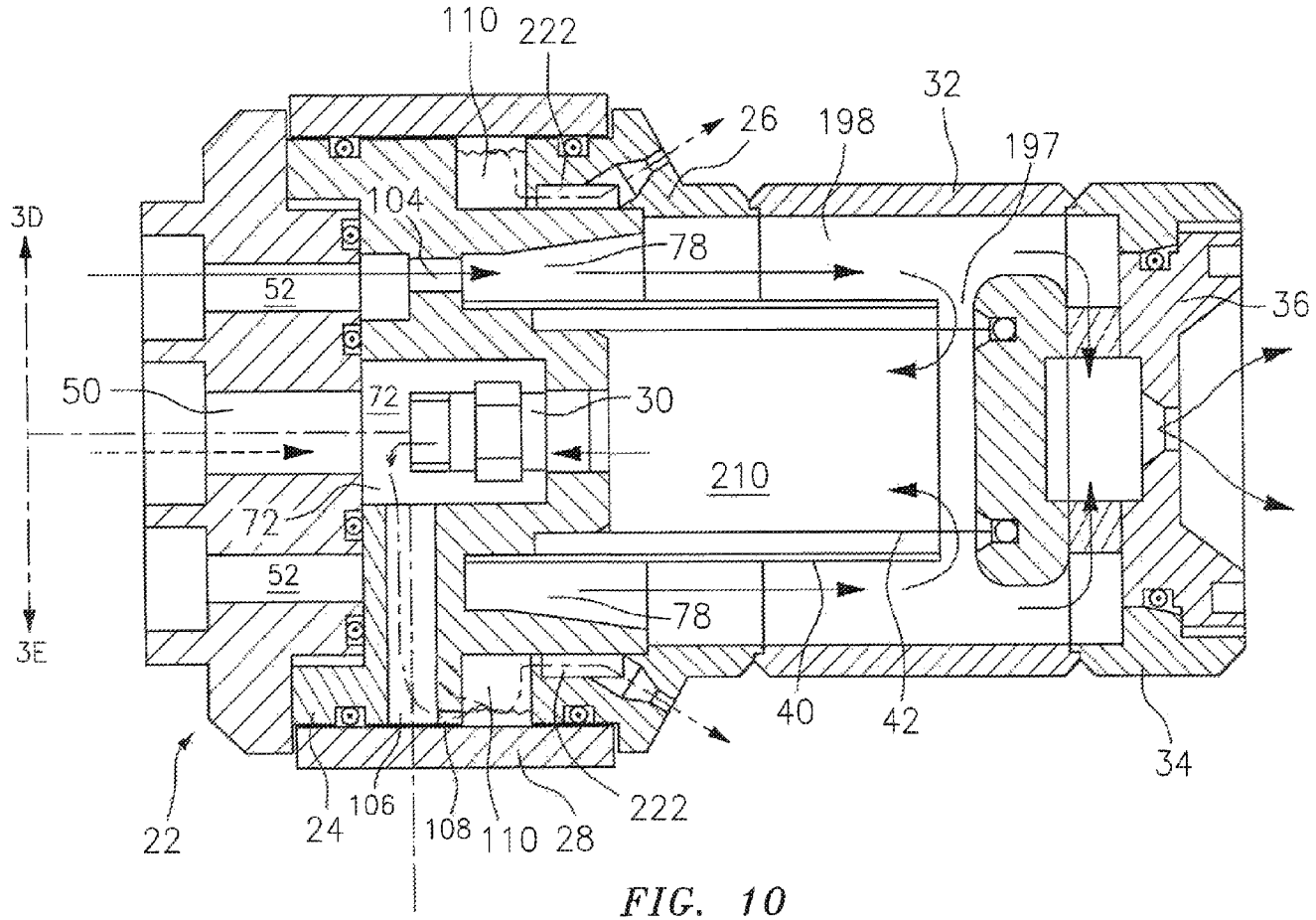
FIG. 10 is a diagrammatic sectional view of an embodiment of the present snowgun, illustrating fluid flow paths through the snowgun.

It should be noted that FIGS. 1 and 10 show a cross-section of the nucleator swirl ring 24 along a first sectional line (labeled as "3D") that passes through an axial passage 104, and along a second sectional line (labeled as "3E") that gasses through a radial passage 106 to facilitate the description of then present snowgun 20.

Figure 4A:
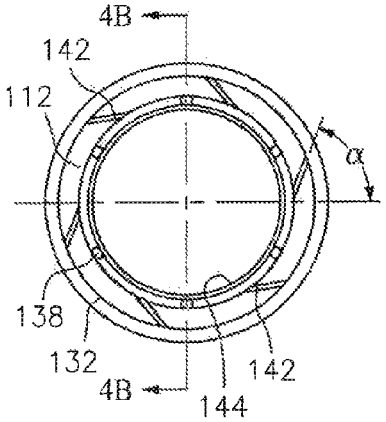
FIG. 4A is a diagrammatic planar view of the first end surface of the nucleator nozzle ring element of the present snowgun.
Figure 4B:
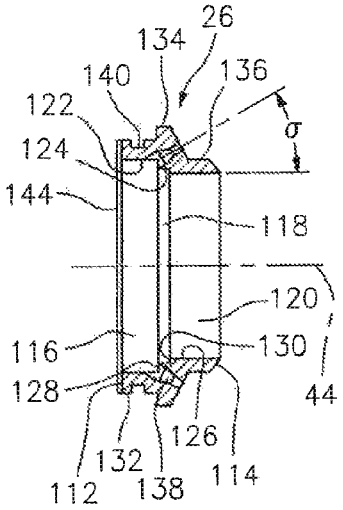
FIG. 4B is a diagrammatic sectional view of the nucleator swirl nozzle ring element of the present snowgun.
Figure 4C:
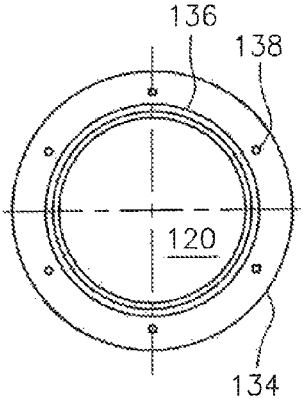
FIG. 4C is a diagrammatic planar view of the second end surface of the nucleator nozzle ring element of the present snowgun.

Referring to FIGS. 4A-4C, the nucleator nozzle ring 26 includes a body extending axially between a first end surface 112 and a second end surface 114, a first cavity 116, a second cavity 118, and a bore 120. The first cavity 116 is defined in part by a first inner diameter surface 122. The second cavity 118 is defined in part by a second inner diameter surface 124. The bore 120 is defined in part by a third inner diameter surface 126. A first radial surface 128 extends between the first inner diameter surface 122 and the second inner diameter surface 124. A second radial surface 130 extends between the second inner diameter surface 124 and the third inner diameter surface 126.

The nucleator nozzle ring 26 further includes a first outer diameter surface 132, a radially extending flange 134, a second outer diameter surface 136, and a plurality of nucleator nozzles 138. A channel 140 for receiving an O-ring is disposed in the first outer diameter surface 132. In the embodiment shown in FIGS. 4A-4C, the second end surface 114 includes a portion of a lap joint, which lap joint permits a mating fit with the intermediary ring 32 when the snowgun 20 is assembled. The nucleator nozzles 138 are disposed, spaced apart from one another, around the circumference of the nucleator nozzle ring 26. Each nucleator nozzle 138 includes a centerline disposed at an angle "σ" (e.g., where σ is in the range of 30-45 degrees) relative to the central axis 44. The embodiment shown in FIGS. 4A-4C shows six (6) nucleator nozzles 138 extending through the flange 134, uniformly spaced around the circumference of the flange. The nozzle ring 26 is not limited to having six nozzles 138.

The nucleator nozzle ring 26 further includes a plurality of swirl passages 142 disposed in the first end surface 112, spaced apart from one another around the circumference of the first end surface 112. Each swirl passage 142 has length that extends along an axis that is disposed at an angle "α" relative to a radial centerline of the nozzle ring. As will be explained below, the angle "α" is such that water passing through the passages 142 in the direction from the first outer diameter surface 132 toward the first cavity 116 enters the first cavity tangentially. As a result, the water is directed to travel (i.e., "swirl") around the circumference of the first cavity 116.

In a preferred embodiment, the nucleator nozzle ring 26 includes a rib 144 disposed at the first end surface edge of the first cavity 116, which rib 144 extends a distance radially inwardly.

Figure 5A:
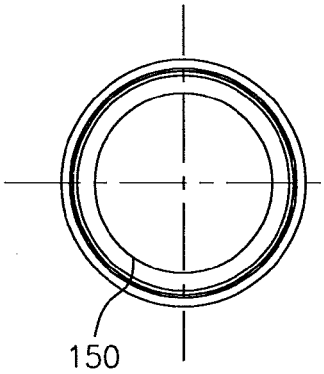
FIG. 5A is a diagrammatic planar view of the first end surface of the primary nozzle ring element of the present snowgun.
Figure 5B:
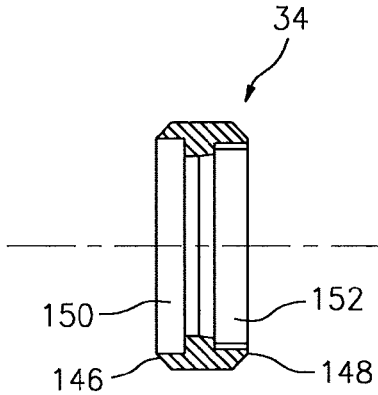
FIG. 5B is a diagrammatic sectional view of the primary nozzle ring element of the present snowgun.
Figure 5C:
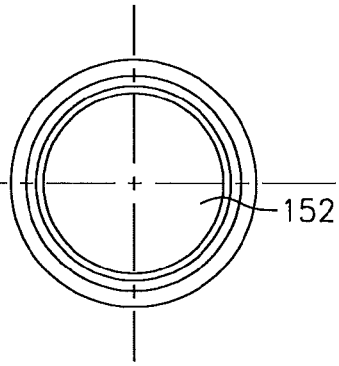
FIG. 5C is a diagrammatic planar view of the second end surface of the primary nozzle ring element of the present snowgun.

Referring to FIGS. 5A-5C, the primary nozzle ring 34 includes a body extending axially between a first end surface 146 and a second end surface 148, a first cavity 150, and a second cavity 152, and a bore extending there between. The first cavity 150 is disposed in the first end surface 146. The second cavity 152 is disposed in the second end surface 148, and includes a threaded inner diameter for thread engagement with the primary nozzle 36. In the embodiment shown in FIGS. 5A-5C, the first end surface 146 includes a portion of a lap joint, which lap joint permits a mating fit with the intermediary ring 32 when the snowgun 20 is assembled.

Figure 8:
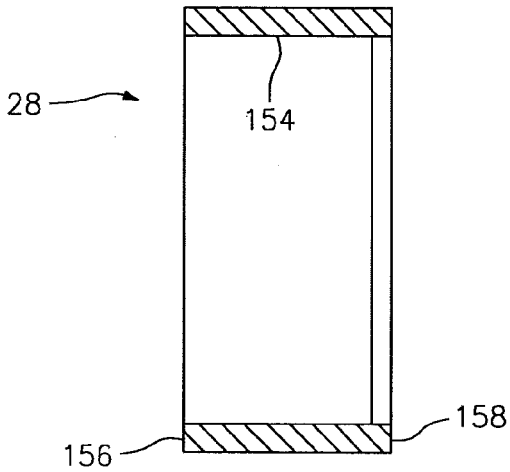
FIG. 8 is a diagrammatic cross-sectional view of the swirl sleeve element of the present snowgun.

Referring to FIG. 8, the swirl sleeve 28 includes a tubular body having an inner diameter surface 154, and which body extends axially between a first end surface 156 and a second end surface 158.

Figure 6A:
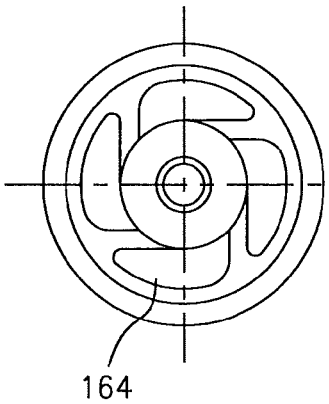
FIG. 6A is a diagrammatic planar view of the first end surface of the primary nozzle element of the present snowgun.
Figure 6B:
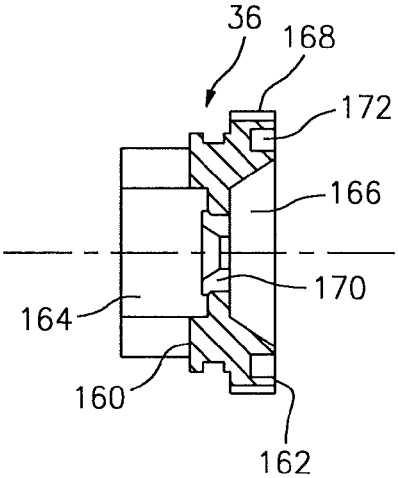
FIG. 6B is a diagrammatic sectional view of the primary nozzle element of the present snowgun.
Figure 6C:
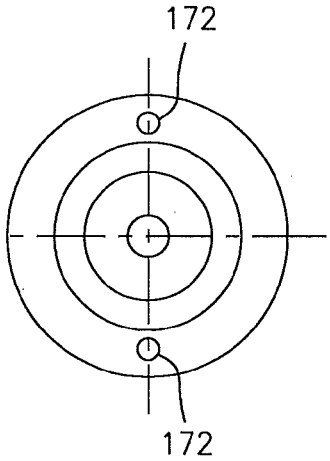
FIG. 6C is a diagrammatic planar view of the second end surface of the primary nozzle ring element of the present snowgun.

Referring to FIGS. 6A-6C, the primary nozzle 36 includes a includes a body extending axially between a first end surface 160 and a second end surface 162, a plurality of flow elements 164, a first cavity 166, a bore, an outer diameter surface 168, and a nozzle insert 170 fixedly attached within the bore. The first cavity 166 is disposed in the second end surface 162, and includes an angled inner diameter wall that increases in radius in the direction toward the second end surface 162. The outer diameter surface 168 is threaded for thread engagement with the threaded inner diameter of the nozzle ring second cavity 118. The embodiment shown in FIGS. 6A-6C shows a pair of circular cavities 172 disposed in the second end surface 162, which cavities are configured for engagement with a tool for moving the primary nozzle 36 relative to the primary nozzle ring 34; e.g., screwing the nozzle 36 into or out of the nozzle ring 26. The flow elements 164 extend axially outwardly from the first end surface 160, spaced apart from one another, each having a distal end. The inter-flow element spacing creates tangential flow passages through which water may enter the nozzle 36 and subsequently exit the snowgun 20. The water exiting the primary nozzle 36 forms a conical-shaped as it extends away from the snowgun 20.

Figure 7:
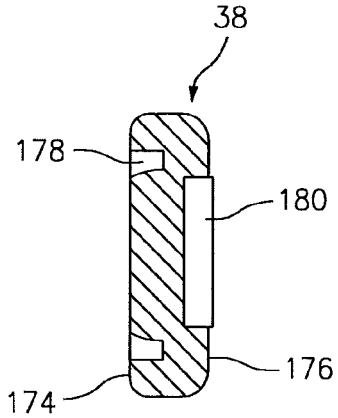
FIG. 7 is a diagrammatic cross-sectional view of the end cap element of the present snowgun.

Referring to FIG. 7, the end cap 38 includes a body extending axially between a first end surface 174 and a second end surface 176. An annular channel 178 is disposed in the first end surface 174, which channel is configured to receive an O-ring. A cavity 180 is disposed in the second end surface 176. The cavity 180 is sized to receive the distal ends of the flow elements 164. Collectively, the end cap 38 and flow elements 164 create a flow swirl chamber which produces a particular orientation for the flow exiting the nozzle 36.

Figure 9:
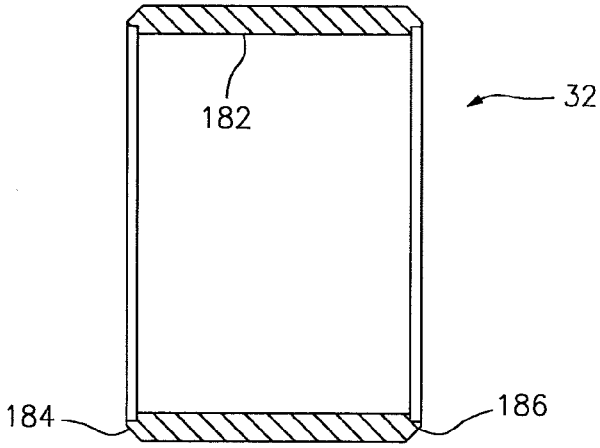
FIG. 9 is a diagrammatic cross-sectional view of the intermediary ring element of the present snowgun.

Now referring to FIG. 9, the intermediary ring 32 includes a tubular body having an inner diameter surface 182, and which body extends axially between a first end surface 184 and a second end surface 186. In the embodiment shown in FIG. 9, the first end surface includes a portion of a lap joint, which lap joint permits a mating fit with the nucleator nozzle ring 26 when the snowgun 20 is assembled. The second end surface 186 also includes a portion of a lap joint, which lap joint permits a mating fit with the primary nozzle ring 34 when the snowgun 20 is assembled.

Now referring to FIG. 1, the internal flow sleeve 40 includes a tubular body having an inner diameter surface 188, and outer diameter 190, and a length extending axially between a first end surface 194 and a second end surface 196. The outer diameter 190 of the internal flow sleeve 40 is less than the inner diameter of the intermediary ring 32. When the snowgun 20 is assembled, the difference in the two diameters creates an axially extending annular cavity 198 through which water may flow. The inner diameter of the internal flow sleeve 40 is sized to receive at least a portion of the first outer diameter surface 98 of the hub 76 portion of the nucleator swirl ring 24; e.g., a slight interference fit to keep the internal flow sleeve 40 attached to the nucleator swirl ring 24. The length of the internal flow sleeve 40 is such that when the snowgun 20 is assembled, the second end surface 196 is spaced apart from the first end surface 174 of the end cap 38, thereby creating a flow passage 197 there between.

Now referring to FIG. 1, the water filter 42 includes a tubular body having an inner diameter 200, a length extending axially between a first end 206 and a second end 208, and an internal cavity 210. The inner diameter 200 of the water filter 42 is sized to receive at least a portion of the second outer diameter surface 100 of the hub 76 portion of the nucleator swirl ring 24; e.g., a slight interference fit to keep the water filter 42 attached to the nucleator swirl ring 24. The length of the water filter 42 is such that when the snowgun 20 is assembled, the first end 206 is engaged with the hub 76 and the second end 208 is engaged with an O-ring disposed in the first end surface 174 of the end cap 38. As a result, water passing through the flow passage 197 formed between the second end surface 196 of the internal flow sleeve 40 and the end cap 38 must pass through the water filter 42 prior to encountering the nucleator metering nozzle 30 as will be explained below. An example of an acceptable water filter 42 is a screen having apertures, each with a diameter that is less than the orifice diameter of the nucleator metering nozzle 30 (e.g., to prevent passage particles or debris of a size that could clog the nucleator metering nozzle orifice). The present invention is not limited to using a screen type water filter 42.

The present snowgun 20 may be assembled in a number of different ways, and is not limited to any particular manner As indicated above, one or more of the elements of the present snowgun 20 may be combined into unitary elements and still be within the scope of the present invention. To illustrate how the snowgun may be assembled in a non-limiting example, the following description is offered.

As can be seen from the FIGURES, when the snowgun 20 is assembled, a portion of the second outer diameter surface 90 of the nucleator swirl ring 24 is received within the first and second cavities 116, 118 of the nucleator nozzle ring 26. The nucleator swirl ring 24 and the nucleator nozzle ring 26 may be joined together by weld, for example.

As described above, the intermediary ring 32, the nucleator nozzle ring 26, and the primary nozzle ring 34 may have mating lap joints. At each lap joint the respective pieces may be welded together. It can be seen, therefore, that the nucleator swirl ring 24, the nucleator nozzle ring 26, the intermediary ring 32, and the primary nozzle ring 34 may be joined together as a unitary piece.

The nucleator metering nozzle 30 may be attached to the hub 76 of the nucleator swirl ring 24 by, for example, screw thread.

The swirl sleeve 28 may be slid over the first outer diameter surfaces 88, 132 of the nucleator swirl ring 24 and the nucleator nozzle ring 26, respectively. The fluid inlet manifold 22 may then be screwed into the nucleator swirl ring 24. The flanges 54, 134 of fluid inlet manifold 22 and the nucleator nozzle ring 26 hold the swirl sleeve 28 in place. As can be seen in FIG. 1, when assembled, a first O-ring 212 seals the interface between the swirl sleeve 28 and the nucleator swirl ring 24, and a second O-ring 214 seals the interface between the swirl sleeve 28 and the nucleator nozzle ring 26. In addition, the annular swirl chamber 110 formed by the nucleator swirl ring 24, the nucleator nozzle ring 26, and the swirl sleeve 28 can be seen from FIG. 1. A third O-ring 216 and a fourth O-ring 218 provides seals between the manifold 22 and nucleator swirl ring 24.

The internal flow sleeve 40 may be inserted through the primary nozzle ring 34 and into the intermediary ring 32 a distance sufficient to allow the first and second outer diameter surfaces 88, 90 of the hub 76 to be received within the internal flow sleeve 40. The second end surface 186 of the internal flow sleeve 40 is slid into contact with the base of the cavity 78 of the nucleator swirl ring 24. As indicated above, the inner diameter 188 of the internal flow sleeve 40 may be sized to form a slight interference fit with the first outer diameter surface 98 of the hub 76 to keep the internal flow sleeve 40 attached to the nucleator swirl ring 24.

The water filter 42 may be inserted through the primary nozzle ring 34 and into the intermediary ring 32 a distance sufficient to allow the second outer diameter surface 100 of the hub 76 to be received within the water filter 42. The second end 208 of the water filter 42 is slid into contact with the first radial surface 102 of the hub 76. The inner diameter 200 of the water filter 42 may be sized to form a tight slid fit or a slight interference fit with the second outer diameter surface 100 of the hub 76 to keep the water filter 42 attached to the nucleator swirl ring 24.

The end cap 38 may be attached to the flow elements of the primary nozzle 36; e.g., by weld.

The primary nozzle 36 (with the end cap 38 attached) may then be inserted into the primary nozzle ring 34. As the nozzle/end cap assembly is slid into the primary nozzle ring 34, the end cap 38 will extend into the intermediary ring 32, and the second end of the water filter 42 will engage an 0-ring 220 disposed in the first end surface channel 178 of the end cap 38. The primary nozzle/end cap assembly can be secured to the primary nozzle ring 34 by screwing the nozzle 36 and the nozzle ring 34 together. An O-ring 224 seals between the primary nozzle 36 and the primary nozzle ring 34.

Referring to FIGS. 1 and 10, in the operation of the snowgun 20, water (depicted as a solid line) at an elevated pressure (e.g., in the range of 250-650 psig) and at a flow rate (e.g., in the range of 10-25 gpm) is directed through the fluid inlet manifold 22, through the arcuate channels 74 and through the plurality of axial passages 104 (e.g., see FIGS. 3A-3D) disposed in the nucleator swirl ring 24. The water exits the axial passages 104 and enters the cavity 78 on the opposite side of the nucleator swirl ring 24.

Figure 11:
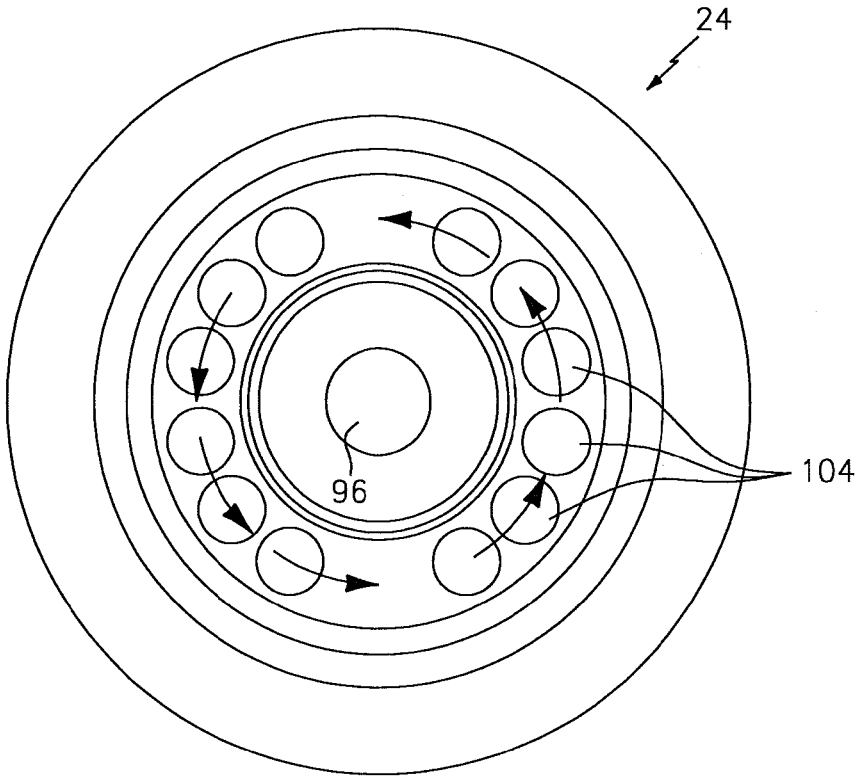
FIG. 11 is an enlarged view of the second end surface view shown in FIG. 3, illustrating fluid swirl direction associated with angled axial passages.

As indicated above, in a preferred embodiment, the axial passages 104 are disposed at a tangential angle (e.g., in the range of 15-20 degrees) relative to the central axis 44 to direct water exiting the axial passages 104 to travel both circumferentially and axially; i.e., a direction that causes the water to circumferentially "swirl" (e.g., diagrammatically shown in FIG. 11 within cavity 78 and beyond in the annular cavity 198). The water swirl within the cavity 78, and the decreasing wall thickness (between the cavity 78 and the second outer diameter surface 90 of the nucleator swirl ring 24), provide advantageous heat transfer in the region. The swirling action enables the water to travel at a faster velocity that would be otherwise possible with only axial travel, and the increased velocity of the water along the inner diameter surface 84 of the cavity 78 assists in the desirable heat transfer. To fully appreciate the significance of the heat transfer, consider that prior to operation the snowgun 20 may initially be at a very low ambient temperature (e.g., low as zero degrees Fahrenheit—0° F.), particularly at start-up when the snowgun 20 is stored outside. After the snowgun is "turned on" and despite an initial water temperature of between 34 and 38 degrees Fahrenheit (34-38° F.), it is possible that one or more of the nucleator nozzles 138 may initially clog with frozen water. The present snowgun 20 addresses this issue, for example, by the water swirl within the cavity 78, and the decreasing wall thickness (between the cavity 78 and the second outer diameter surface 90 of the nucleator swirl ring 24). Heat transfer from the water increases the temperature of the snowgun 20 and thaws any nucleator nozzle 138 that may be clogged with frozen water in a very short period of time. This is particularly advantageous because in the absence of fluid flow through the nucleator nozzles 138 (and the production of frozen particles—sometimes referred to as "nuclei" via the nozzles) the ability of the snowgun 20 to produce snow is negatively affected.

The water exits the cavity 78 and enters the annular flow passage 198 formed between the internal flow sleeve 40 and the intermediary ring 32. A portion of the water then travels through the passage 197 formed between the second end surface 196 of the internal flow sleeve 40 and the first end surface 174 of the end cap 38, through the water filter 42, and into the internal cavity 210 of the water filter 42. Once in the internal cavity 210, the water travels toward and through the nucleator metering nozzle 30. As indicated above, the apertures in the water filter 42 are smaller in diameter than the nucleator metering nozzle orifice to decrease the possibility of the nucleator metering nozzle orifice getting clogged. Water used for snow making purposes is often drawn from a natural source (e.g., a stream or pond) and consequently often contains debris from the source or debris (e.g., rust) from the piping supplying the water to the snowgun. Hence, the filter 42 increases the operational reliability of the snowgun 20. In addition, the internal flow sleeve 40 creates a desirable fluid flow path internally within the snowgun 20. Specifically, the internal flow sleeve 40 forces the water flow within the annular flow passage 198 to travel substantially all of the passage 198. As a result, the water travels within the passage 198 provides desirable heat transfer relative to the intermediary ring 32. In addition, in the absence of the internal flow sleeve 40, a pressure gradient within the annular flow passage 198 can cause undesirable recirculating flow patterns; e.g., water flow entering the filter 42 proximate the end cap 38 may travel within the internal cavity 210 of the filter 42 and exit the cavity 210 and enter back into the annular flow passage 198 proximate the nucleator swirl ring hub 76.

The remainder of the water flow through the annular flow passage 198 (i.e., the portion of the water that does not enter the water filter 42) travels past the end cap 38 and enters the primary nozzle 36 via the tangential flow passages between the flow elements 164. From there the water exits the primary nozzle 36 in a defined conical geometry and into the atmosphere.

At the same time the water is passing through the snowgun, air (depicted as a dotted line) at an elevated pressure (e.g., in the range of 40-100 psig) and flow rate (e.g., in the range of 20-40 scfm) is directed into the centrally located air passage 50 within the fluid inlet manifold 22, through the manifold 22 and into the metering nozzle cavity 72. At this point the air mixes with the water passing through the nucleator metering nozzle 30 (air-water mixture is depicted as a dash dot dash line) and is directed out of the metering nozzle cavity 72 via the radial passages 106 extending between the metering nozzle cavity 72 and the respective angled passage 108 (e.g., see FIG. 3A), and into the swirl chamber 110 formed by the nucleator swirl ring 24, the nucleator nozzle ring 26, and the swirl sleeve 28 (e.g., see FIG. 10). The air-water mixture exiting the angled passages 108 and tangentially entering the swirl chamber 110 travels at very high rate of speed circumferentially within the swirl chamber 110. Centrifugal forces maintain the mixture along the outer radial portion of the swirl chamber 110; e.g., against the inner diameter surface 154 of the swirl sleeve 28. Here again, the present snowgun 20 design provides advantageous heat transfer from fluids (e.g., the air-water mixture) to the snowgun 20.

An example of flows within the swirl chamber 110 could be 30 cubic feet per minute (cfm) air with 0.5 gallons per minute (gpm) water; i.e., an air/water ("A/W") ratio of sixty (60). In this example, the air in the swirl chamber 110 may be swirling at a velocity of about 100 feet per second, and water film on the radially outer surface at about 20 feet per second. The gravitational forces (i.e., "G" forces) may be on the order of 125 G's, assuring a uniform layer of water disposed on the outer periphery.

To illustrate the significance of the present snowgun 20 design, consider the operation of a prior art snowgun. Most snowguns are attached to long stands that position the snowgun many feet above the surface to be covered with snow—the higher the snowgun, the greater potential reach of the snowgun and the greater the distance the snowgun produced mixture must travel before reaching the ground. The quality of the snow made by the snowgun typically increases with the amount of time the mixture is airborne. In many prior art snowguns, it is not uncommon for ice to build up on the snowgun during operation. If enough ice builds up, the snowgun can freeze and stop producing snow. Once the snowgun stops flowing, any water within the piping leading to the snowgun becomes static and susceptible to freezing and potentially rupturing the piping. The present snowgun 20 design addresses this issue, for example, by heat transfer to the snowgun 20 from the air-water mixture swirling with swirl chamber 110, thereby inhibiting ice formation on the exterior of the snowgun 20.

The air-water mixture traveling circumferentially within the swirl chamber 110 also travels axially, and encounters the plurality of swirl passages 142 disposed in the first end surface 112 of the nucleator nozzle ring 26. The orientation of the swirl passages 142 (e.g., the swirl passage length extending along an axis that is disposed at an angle "a" relative to a radial centerline of the nozzle ring) enables the air-water mixture circumferentially traveling within the swirl chamber 110 to readily exit the swirl chamber 110 in a tangential manner. The air-water mixture travels through the swirl passages 142 (in a direction that is in part radially inward) and enters a nucleator annular chamber 222 formed between the second outer diameter surface 90 of the nucleator swirl ring 24 and the first inner diameter surface 124 of the first cavity 116 of the nucleator nozzle ring 26. Once the air-water mixture is within the nucleator annular chamber 222, the mixture travels circumferentially and axially, and subsequently passes out through the nucleator nozzles 138. In the preferred embodiment that includes a rib 144 disposed at the first end surface edge of the first cavity 116, the rib 144 helps to maintain the air-water mixture within the nucleator annular chamber 222. The "swirling" (i.e., circumferential travel at a high velocity) of the air-water mix within the nucleator annular chamber 222 provides several advantages. First the swirling provides a uniform distribution of air-water mixture to the nucleator nozzles 138. Second, the centrifugal forces acting on the swirling the air-water mixture are also strong enough to overcome gravitational forces acting on the air-water mixture. In operation, snowguns may be positioned in a variety of different orientations. Most of these orientations are such that gravitational forces will, in the absence of the swirl, cause water to collect in the vertically lower portion of the nucleator (the gravitational vector being vertical), thereby negatively influencing the uniformity of the air-water mixture being dispersed through the nucleator nozzles around the circumference of the gun. The swirling flow within the present snowgun 20 solves this problem.

The air-water mixture exiting the nucleator nozzles 138 forms a conical shaped body of air-water mixture. The geometry of the conical shaped body is a function in part of the angle "σ" at which the nucleator nozzles 138 are disposed in the nucleator nozzle ring 26. As indicated above, the water exiting the snow gun 20 from the primary nozzle also font's a conical shaped body extending away from the snowgun 20. At some distance from the snowgun 20, the air-water mixture exiting the nucleator nozzles 138 and the water exiting the primary nozzle mix. Nuclei formed within the air-water mixture interact with the water from the primary nozzle 36 to create snow under the right atmospheric conditions.

The present snowgun can provide an overall air to water (A/W) ratio (cfm/gpm) of about 2.0 at marginal (26-27 degrees F.) wet bulb temperatures . . . see evaporative cooling, and a minimum level of about 0.9 when colder temperatures allow.

Although this invention has been shown and described with respect to the detailed embodiments thereof, it will be understood by those skilled in the art that various changes in form and detail thereof may be made without departing from the spirit and the scope of the invention.

What is claimed is:

1. A snow making apparatus, comprising:

a manifold configured to receive water from a water source and configured to receive air from an air source;

a nucleator annular chamber configured to receive an air-water mixture from first passages, which first passages are oriented to direct the air-water mixture tangentially into the nucleator annular chamber for subsequent circumferential and axial travel within the annular chamber; and a plurality of nucleator nozzles, which nozzles are positioned to receive the air-water mixture from the nucleator annular chamber, and which nozzles are configured to allow the air-water mixture to exit the apparatus through the nozzles.

2. The snow making apparatus of claim 1, wherein the nucleator annular chamber and first passages are configured to cause the air-water mixture circumferentially and axially traveling within the nucleator annular chamber to experience centrifugal forces sufficient to overcome gravitational forces during normal operating conditions.

3. The snow making apparatus of claim 2, wherein the nucleator annular chamber and first passages are configured such that the centrifugal forces direct the air-water mixture toward an outer radial surface of the nucleator annular chamber during normal operating conditions.

4. The snow making apparatus of claim 1, wherein the apparatus is configured such that the water received from the water source includes a portion that is directed to travel through a nucleator mix nozzle, and the remainder of the water received from the water source is directed to exit the apparatus through a primary nozzle.

5. The snow making apparatus of claim 1, further comprising a filter having an aft end, which filter is positioned such that the nucleator mix nozzle portion of the water passes through the filter prior to passing through the nucleator mix nozzle.

6. The snow making apparatus of claim 5, wherein the water filter is a screen.

7. The snow making apparatus of claim 5, wherein the snow making apparatus further comprises an internal flow sleeve positioned concentrically outside the filter, wherein an annular cavity is formed within the apparatus in part by the internal flow sleeve, and the sleeve is configured to form a flow passage located adjacent the aft end of the water filter, wherein the nucleator mix nozzle portion of the water passes through the flow passage prior to entering the water filter.

8. The snow making apparatus of claim 7, further comprising a ring having a plurality of water passages positioned to receive the water from the manifold, which passages are disposed at a tangential angle relative to a central axis of the apparatus, which angle directs water exiting the water passages to travel both circumferentially and axially and experience centrifugal forces during normal operating conditions.

9. The snow making apparatus of claim 8, wherein the water passages are configured such that the centrifugal forces direct the water mixture toward an outer radial surface of a cavity within the ring during normal operating conditions.

10. A snow making apparatus, comprising:

a manifold configured to receive water from a water source and configured to receive air from an air source;

a nucleator mix nozzle;

a primary nozzle;

an annular cavity disposed downstream of the manifold, configured to receive the water from the manifold; and a filter having an aft end, which filter is configured to receive a portion of the water traveling through the annular cavity, which portion is directed to travel through the nucleator mix nozzle, and the remaining portion of the water traveling through the annular cavity is directed to exit the apparatus through the primary nozzle;

wherein the snow making apparatus further comprises an internal flow sleeve positioned concentrically outside the filter, wherein the annular cavity is formed within the apparatus in part by the internal flow sleeve, and the sleeve is configured to formed a flow passage located adjacent the aft end of the water filter, wherein the nucleator mix nozzle portion of the water passes through the flow passage prior to entering the water filter.

11. The snow making apparatus of claim 10, further comprising a ring having a plurality of water passages positioned to receive the water from the manifold, which passages are disposed at a tangential angle relative to a central axis of the apparatus, which angle directs water exiting the water passages to travel both circumferentially and axially and experience centrifugal forces during normal operating conditions.

12. The snow making apparatus of claim 11, wherein the water passages are configured such that the centrifugal forces direct the water mixture toward an outer radial surface of a cavity within the ring during normal operating conditions.

13. A snow making apparatus, comprising:

a manifold configured to receive water from a water source and configured to receive air from an air source;

a first ring having a plurality of water passages positioned to receive the water from the manifold;

a second ring having a plurality of nucleator nozzles;

a primary nozzle attached to a primary nozzle ring;

a nucleator mix nozzle; and a nucleator annular chamber configured to receive an air-water mixture from first passages disposed in the second ring, which first passages are oriented to direct the air-water mixture tangentially into the nucleator annular chamber for subsequent circumferential and axial travel within the annular chamber;

wherein the nucleator nozzles are positioned to receive the air-water mixture from the nucleator annular chamber, and which nozzles are configured to allow the air-water mixture to exit the apparatus through the nozzles.

14. The snow making apparatus of claim 13, wherein the nucleator annular chamber and first passages are configured to cause the air-water mixture circumferentially and axially traveling within the nucleator annular chamber to experience centrifugal forces sufficient to overcome gravitational forces during normal operating conditions, which centrifugal forces direct the air-water mixture toward an outer radial surface of the nucleator annular chamber during normal operating conditions.

15. The snow making apparatus of claim 14, wherein the apparatus is configured such that the water passing through the first ring enters an annular cavity, and includes a portion that is directed to travel through the nucleator mix nozzle, and the remainder of the water is directed to exit the apparatus through the primary nozzle.

16. The snow making apparatus of claim 15, further comprising a filter having an aft end, which filter is positioned such that the nucleator mix nozzle portion of the water passes through the filter prior to passing through the nucleator mix nozzle.

17. The snow making apparatus of claim 16, wherein the snow making apparatus further comprises an internal flow sleeve positioned concentrically outside the filter, wherein the annular cavity is formed within the apparatus in part by the internal flow sleeve, and the sleeve is configured to form a flow passage located adjacent the aft end of the water filter, wherein the nucleator mix nozzle portion of the water passes through the flow passage prior to entering the water filter.

18. The snow making apparatus of claim 13, wherein the water passages disposed in the first ring are positioned to receive the water from the manifold, which passages are disposed at a tangential angle relative to a central axis of the apparatus, which angle directs water exiting the water passages to travel both circumferentially and axially and experience centrifugal forces during normal operating conditions.

19. The snow making apparatus of claim 18, wherein the water passages are configured such that the centrifugal forces direct the water mixture toward an outer radial surface of a cavity within the first ring during normal operating conditions.

* * * * *